US011761686B2

(12) United States Patent
Pham et al.

(10) Patent No.: US 11,761,686 B2
(45) Date of Patent: Sep. 19, 2023

(54) METHODS AND SYSTEMS FOR CONTROLLING INTEGRATED AIR CONDITIONING SYSTEMS

(71) Applicant: Carrier Corporation, Palm Beach Gardens, FL (US)

(72) Inventors: Batung Pham, Chassieu (FR); Pierre Delpech, Fleurieu sur Saone (FR); Philippe Rigal, Savigneux (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 18/155,387

(22) Filed: Jan. 17, 2023

(65) Prior Publication Data

US 2023/0143201 A1 May 11, 2023

Related U.S. Application Data

(60) Continuation of application No. 15/888,504, filed on Feb. 5, 2018, now abandoned, which is a division of (Continued)

(51) Int. Cl.
*F25B 25/00* (2006.01)
*F25B 41/00* (2021.01)
(Continued)

(52) U.S. Cl.
CPC ..... *F25B 25/00* (2013.01); *F25B 41/00* (2013.01); *F25B 2400/04* (2013.01);
(Continued)

(58) Field of Classification Search
CPC ..... F25B 49/02; F25B 49/022; F25B 2400/0401; F25D 1/00; F25D 15/00;
(Continued)

(56) References Cited

U.S. PATENT DOCUMENTS 1,887,909 A 11/1932 Altenkirch
2,048,711 A 7/1936 Ridge
(Continued)

FOREIGN PATENT DOCUMENTS

CN 1033868 A 7/1989
DE 10029660 A1 1/2002
(Continued)

OTHER PUBLICATIONS

European Search Report Issued in EP Application No. 07838387.4, dated Jun. 4, 2018, 6 Pages.
(Continued)

*Primary Examiner* — Jonathan Bradford
(74) *Attorney, Agent, or Firm* — CANTOR COLBURN LLP

(57) ABSTRACT

An integrated air conditioning system having a first air conditioning unit having a first evaporator with a first input and a first output; a second air conditioning unit having a second evaporator with a second input and a second output; a first conduit fluidly connecting the first input with the second output; a second conduit fluidly connecting the second input with the first output. The first and second conduits and the first and second evaporators form a working fluid circuit.

5 Claims, 2 Drawing Sheets

Related U.S. Application Data application No. 12/674,135, filed as application No. PCT/US2007/020170 on Sep. 18, 2007, now Pat. No. 9,909,790.

(51) Int. Cl.

| | |
|---|---|
| *F25D 17/02* | (2006.01) |
| *F25D 16/00* | (2006.01) |
| *F25D 15/00* | (2006.01) |

(52) U.S. Cl.

CPC ..... *F25B 2400/0401* (2013.01); *F25B 2400/0411* (2013.01); *F25B 2400/06* (2013.01); *F25B 2500/31* (2013.01); *F25D 15/00* (2013.01); *F25D 16/00* (2013.01); *F25D 17/02* (2013.01)

(58) Field of Classification Search

CPC ..... F25D 16/00; F25D 17/02; F24F 1/0035; F24F 1/0007; F24F 1/0038

See application file for complete search history.

(56) References Cited

U.S. PATENT DOCUMENTS

| | | | |
|---|---|---|---|
| 4,372,129 | A | 2/1983 | Bennett et al. |
| 5,743,110 | A | 4/1998 | Laude-Bousquet |
| 6,023,935 | A | 2/2000 | Okazaki et al. |
| 6,038,874 | A | 3/2000 | van der Walt et al. |
| 6,038,879 | A | 3/2000 | Turcotte et al. |
| 6,094,925 | A | 8/2000 | Arshansky et al. |
| 6,644,038 | B1 | 11/2003 | Acharya et al. |
| 6,644,049 | B2 | 11/2003 | Alford |
| 8,528,348 | B2 | 9/2013 | Ebigt et al. |
| 8,991,194 | B2 | 3/2015 | Edwards et al. |
| 9,909,790 | B2 | 3/2018 | Pham et al. |
| 2002/0164944 | A1 | 11/2002 | Haglid |
| 2004/0050093 | A1 | 3/2004 | Lifson et al. |
| 2006/0010893 | A1 | 1/2006 | Dominguez |
| 2006/0150644 | A1 | 7/2006 | Wruck |
| 2007/0056312 | A1 | 3/2007 | Kobayashi |
| 2007/0130971 | A1 | 6/2007 | Thybo et al. |
| 2008/0016890 | A1 | 1/2008 | Dominguez |
| 2009/0019874 | A1 | 1/2009 | Park |
| 2010/0023166 | A1 | 1/2010 | Chessel et al. |
| 2010/0036530 | A1 | 2/2010 | Chessel et al. |
| 2010/0042265 | A1 | 2/2010 | Rigal et al. |
| 2010/0070082 | A1 | 3/2010 | Chessel et al. |
| 2010/0107659 | A1 | 5/2010 | Hildreth, Jr. |
| 2011/0094246 | A1 | 4/2011 | Pham et al. |
| 2013/0180278 | A1 | 7/2013 | Yamashita et al. |
| 2018/0156505 | A1 | 6/2018 | Pham et al. |

FOREIGN PATENT DOCUMENTS

| | | | |
|---|---|---|---|
| JP | 09273876 | A | 10/1997 |
| JP | 10300265 | A | 11/1998 |
| JP | 2000314565 | A | 11/2000 |
| JP | 2002048359 | A | 2/2002 |
| WO | 2006112570 | A1 | 10/2006 |
| WO | 2009038552 | A1 | 3/2009 |

OTHER PUBLICATIONS

European Search Report Issued in EP Application No. 07838387.4, dated Nov. 13, 2000, 7 Pages.

India Examination Report Issued in IN Application No. 751/DELNP/2010, dated Oct. 26, 2017, 7 Pages.

International Search Report and Written Opinion; International Application No. PCT/US2007/020170; Intenrational Filing Date: Sep. 18, 2017; dated Mar. 24, 2008; 9 Pages.

METHODS AND SYSTEMS FOR CONTROLLING INTEGRATED AIR CONDITIONING SYSTEMS

CROSS-REFERENCE TO RELATED APPLICATIONS

This application is a continuation application of U.S. application Ser. No. 15/888,504 filed Feb. 5, 2018, which is a division of U.S. patent application Ser. No. 12/674,135 filed Feb. 18, 2010, and further claims the benefit of an earlier filing date from PCT/US2007/020170, filed Sep. 18, 2007, the contents of which are incorporated by reference herein in their entirety.

BACKGROUND OF THE INVENTION

1. Field of the Invention

The present disclosure is related to air conditioning systems. More particularly, the present disclosure is related to methods and systems for controlling integrated air conditioning systems having at least two air conditioning systems.

2. Description of Related Art

During the typical operation of air conditioning systems, the system is run in a cooling mode wherein energy is expended by operating a compressor. The compressor compresses and circulates a refrigerant to chill or condition a working fluid, such as air or other secondary loop fluid (e.g., chilled water or glycol), in a known manner. The conditioned working fluid can then be used in a refrigerator, a freezer, a building, an automobile, and other spaces with climate controlled environment.

However, when the outside ambient temperature is low, there exists the possibility that the outside ambient air itself may be utilized to provide cooling to the working fluid without engaging the compressor. When the outside ambient air is used by an air conditioning system to condition the working fluid, the system is referred to as operating in a free-cooling mode.

As noted above, traditionally, even when the ambient outside air temperature is low, the air conditioning system is run in the cooling mode. Running in cooling mode under such conditions provides a low efficiency means of conditioning the working fluid. In contrast, running the air conditioning system under such conditions in a free-cooling mode is more efficient. In the free-cooling mode, one or more ventilated heat exchangers and pumps are activated so that the refrigerant is circulated by the pumps and is cooled by the outside ambient air. In this manner, the refrigerant, cooled by the outside ambient air, can be used to cool the working fluid without the need for the low efficiency compressor.

Accordingly, it has been determined by the present disclosure that there is a need for methods and systems that improve the efficiency of integrated air conditioning systems.

BRIEF SUMMARY OF THE INVENTION

An integrated air conditioning system having a first air conditioning unit having a first evaporator with a first input and a first output; a second air conditioning unit having a second evaporator with a second input and a second output; a first conduit fluidly connecting the first input with the second output; a second conduit fluidly connecting the second input with the first output, wherein the first and second conduits and the first and second evaporators form a working fluid circuit.

An integrated air conditioning system, having a first air conditioning unit having a first evaporator with a first inlet and a first outlet, a first pump, and a first refrigeration circuit, the first air conditioning unit having a first cooling mode and first free-cooling mode; a second air conditioning unit having a second evaporator with a second inlet and a second outlet, a second pump, and a second refrigeration circuit, the second air conditioning unit having a second cooling mode and a second free-cooling mode; a first conduit fluidly connecting the first input with the second output; a second conduit fluidly connecting the second input with the first output, wherein the first and second conduits and first and second evaporators form a working fluid circuit through which a working fluid flows.

A method for controlling an integrated air conditioning system having a first air conditioning unit and a second air conditioning unit, in which the first air conditioning unit and the second air conditioning unit are in heat exchange communication with a working fluid. The method includes switching the first air conditioning unit from a cooling mode to a free-cooling mode; and operating the second air conditioning unit for a predetermined period of time after switching the first air conditioning unit into the free-cooling mode.

The above-described and other features and advantages of the present disclosure will be appreciated and understood by those skilled in the art from the following detailed description, drawings, and appended claims.

DETAILED DESCRIPTION OF THE INVENTION

Figure 1:
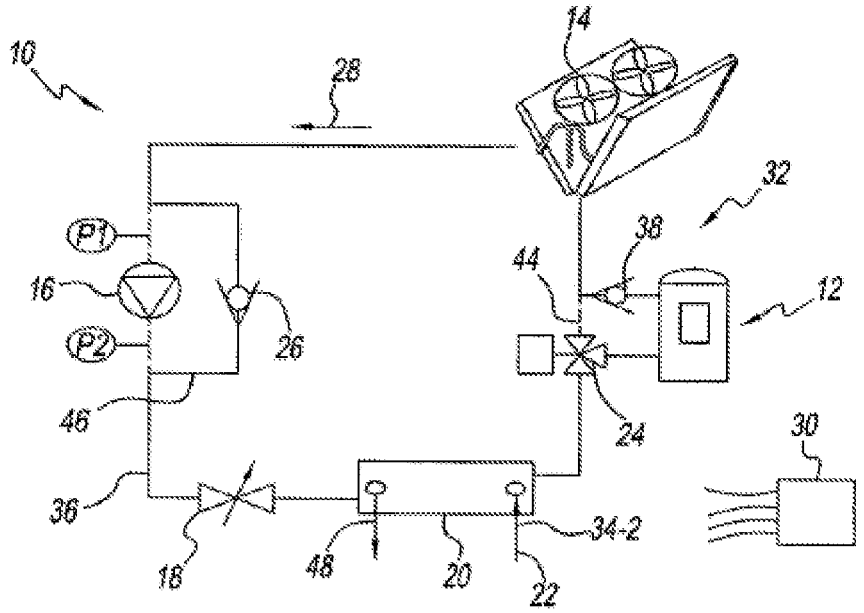
FIG. 1 is an exemplary embodiment of an air conditioning unit in cooling mode according to the present disclosure.
Figure 2:
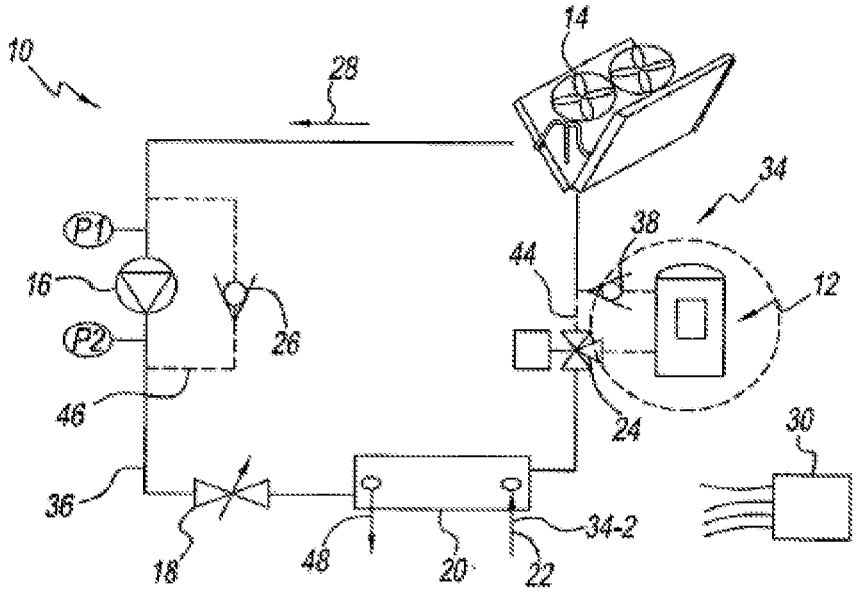
FIG. 2 is an exemplary embodiment of an air conditioning unit in free-cooling mode according to the present disclosure.
Figure 3:
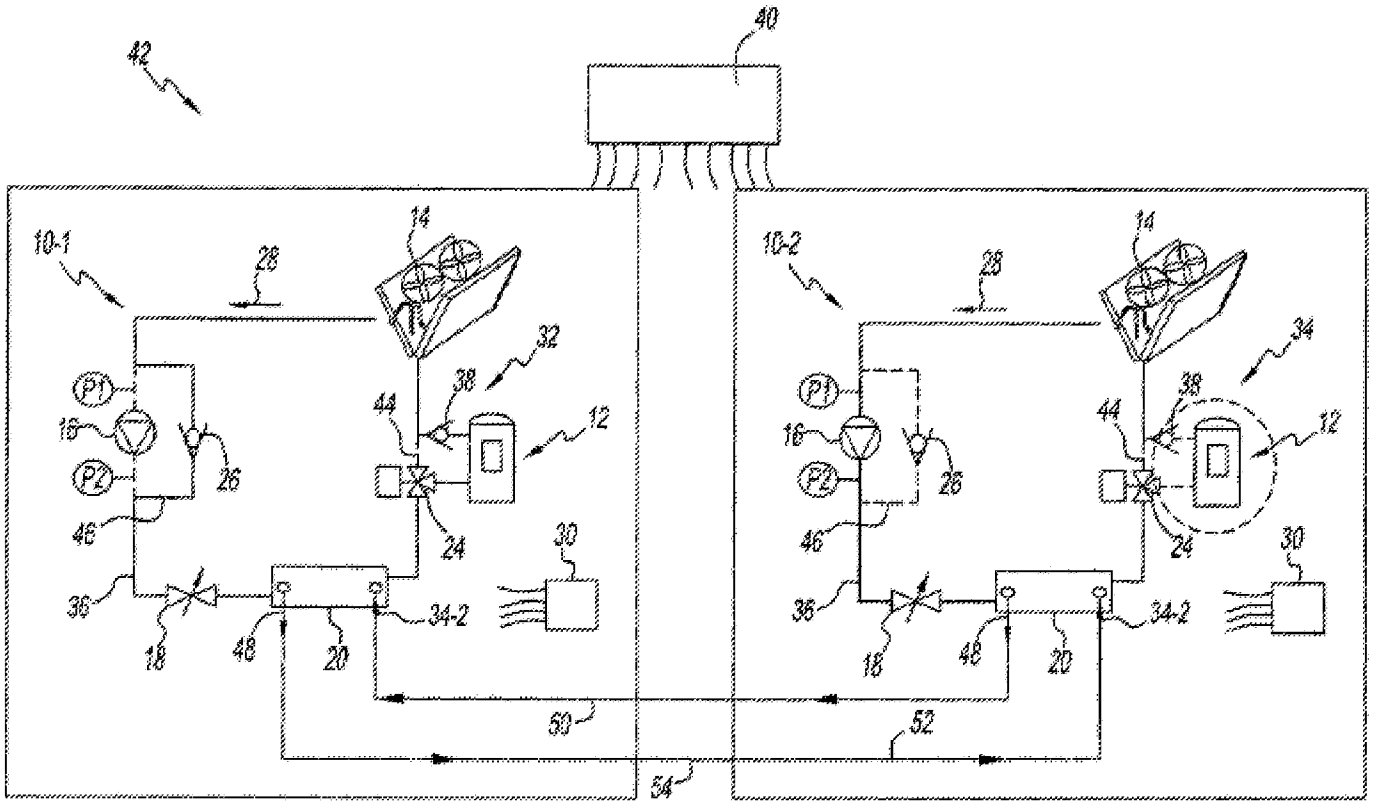
FIG. 3 illustrates an exemplary embodiment of an air conditioning system comprised of the air conditioning units of FIGS. 1 and 2 according to the present disclosure.

Referring now to the drawings and in particular to FIGS. 1 and 2, an exemplary embodiment of an air conditioning unit ("unit") according to the present disclosure, generally referred to by reference numeral 10, is shown. As seen in FIG. 3, two air conditioning units 10-1 and 10-2 can be integrated to form an air conditioning system 42. Advantageously, air conditioning system 42 provides for working fluid 22 to pass from unit 10-1 to unit 10-2 during a switch from cooling mode to free-cooling mode, or vice versa. Thus, there is no stoppage in the conditioning of the working fluid.

Unit 10 includes a controller 30 for selectively switching between cooling and free-cooling modes 32, 34. Unit 10 also includes a refrigeration circuit 36 that includes a condenser 14, a pump 16, an expansion device 18, an evaporator 20, an evaporator input 34, an evaporator output 48, and a compressor 12. Controller 30 selectively controls either compressor 12 (when in cooling mode 32) or pump 16 (when in free-cooling mode 34) to circulate a refrigerant through system 10 in a flow direction 28. Thus, unit 10, when in cooling mode 32, controls compressor 12 to compress and circulate the refrigerant in flow direction 28. However, unit 10, when in free-cooling mode 34, controls pump 16 to circulate the refrigerant in flow direction 28. As such, free-cooling mode 34 uses less energy than cooling mode 32 since the free-cooling mode does not require the energy expended by compressor 12.

Unit 10 includes a compressor by-pass loop 46 and a pump by-pass loop 34. Unit 10 includes one or more valves 24, 26, and 38. Valves 24, 26, and 38 are controlled by controller 30 in a known manner. Thus, controller 30 can selectively position valves 24, 26, and 38 to selectively open and close by-pass loops 44, 46 as desired.

In cooling mode 32, controller 30 controls valves 24, 26, and 38 so that compressor by-pass loop 44 is closed and pump by-pass loop 46 is open. In this manner, unit 10 allows compressor 12 to compress and circulate refrigerant in flow direction 28 by flowing through pump by-pass loop 46.

In contrast, controller 30, when in free-cooling mode 34, controls valves 24, 26, and 38 so that compressor by-pass loop 44 is open and pump by-pass loop 46 is closed. In this manner, unit 10 allows pump 16 to circulate refrigerant in flow direction 28 by flowing through compressor by-pass loop 44.

Evaporator 20 includes evaporator input 34 (through which working fluid 22 enters the evaporator) and evaporator output 48 through which working fluid 22 exits the evaporator. Within evaporator 20, working fluid 22 is in heat-exchange communication with the refrigerant in both cooling and free-cooling modes 32, 34. Working fluid 22 can be ambient indoor air or a secondary loop fluid such as, but not limited to, chilled water or glycol.

In cooling mode 32, unit 10 operates as a standard vapor-compression air conditioning system known in the art in which the compression and expansion of refrigerant via expansion device 18 are used to condition working fluid 22. Expansion device 18 can be any known controllable expansion device such as, but not limited to, a thermal expansion valve.

In free-cooling mode 34, unit 10 takes advantage of the heat removing capacity of outdoor ambient air, which is in heat exchange relationship with condenser 14 via one or more fans to condition working fluid 22.

Although unit 10 is described herein as a conventional air conditioning (cooling) unit, one skilled in the art will recognize that unit 10 may also be a heat pump system to provide both heating and cooling by adding a reversing valve (not shown) so that condenser 14 (i.e., the outdoor heat exchanger) functions as an evaporator in the heating mode and evaporator 20 (i.e., the indoor heat exchanger) functions as a condenser in the heating mode.

Unfortunately, it has been determined by the present disclosure that when controller 30 initiates a switchover from cooling mode 32 to free-cooling mode 34, or vice versa, refrigeration circuit 36 is temporarily stopped. When refrigeration circuit 36 is stopped, the heat-exchange between the refrigerant and working fluid 22 is diminished resulting in a warming of the working fluid. This is counterproductive in that when unit 10 is re-activated, working fluid 22 will have to be conditioned once again.

The present disclosure contemplates an air conditioning system 42, wherein air conditioning units 10-1, 10-2 are integrated systematically and configured such that working fluid 22 circulates through each of the systems. Advantageously, when one of units 10-1 or 10-2 is temporarily stopped during a switchover between cooling and free-cooling modes, or vice versa, the other unit is running and conditioning working fluid 22, thus preventing an undue warming of working fluid 22.

Referring now to FIG. 3, an exemplary embodiment of system 42 according to the present disclosure is shown. System 42 includes a controller 40. In one embodiment of the present disclosure, controller 40 is in electrical communication with each one of controllers 30 of air conditioning units 10-1 and 10-2 and coordinates the operation of the units when either of the units is temporarily stopped during a switchover from cooling mode 32 to free-cooling mode 34, or vice versa.

System 42 contains first conduit 50 and second conduit 52. In the embodiment of system 42 shown in FIG. 3, first conduit 50 fluidly connects evaporator output 48 of unit 10-2 to evaporator input 34 of unit 10-1, thereby allowing working fluid to flow freely between the evaporators. Second conduit 52 fluidly connects evaporator output 48 of unit 10-1 to evaporator input 34 of unit 10-2. In one embodiment of the present disclosure, first and second conduits 50, 52 are pipes. Advantageously, the addition of first and second conduits 50, 52 form working fluid circuit 54 through which working fluid 22 flows freely between units 10-1 and 10-2. Advantageously, when either unit 10-1 or 10-2 is temporarily halted during a switchover between modes, working fluid 22 continues to be conditioned by the other system which is still operating.

It should be recognized that although system 10-1 is shown in cooling mode 32 and system 10-2 is shown in free-cooling mode 34, systems 10-1 and 10-2 can be operating in any mode. Furthermore, either system 10-1 or 10-2 can be in the switchover between modes, while the other system is running.

It should also be recognized that even though system 42 is shown having two units 10-1 and 10-2, it is contemplated by the present disclosure that system 42 can have more than two systems.

In operation, at least one of units 10-1 and 10-2 is operating in cooling mode 32. For purposes of example only, unit 10-1 is operating in cooling mode 32. When controller 30 of unit 10-1 determines that sufficient conditions are present to run unit 10-1 in free-cooling mode 34, controller 30 communicates with controller 40. If unit 10-2 is currently running, unit 10-2 will continue running. However, if unit 10-2 is not running, controller 40 sends a signal to controller 30 to turn on unit 10-2 in cooling mode. After unit 10-2 is turned on and running, unit 10-1 initiates a switchover from cooling mode 32 to free-cooling mode 34. Advantageously, working fluid 22 continues to be conditioned by unit 10-2 when unit 10-1 is transitioning from cooling mode 32 to free-cooling mode 34.

Although the above example refers to a switchover between cooling mode 32 to free-cooling mode 34, it should be recognized that unit 10-2 may be running in cooling mode 32 and be transitioning to free-cooling mode 34.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A method for controlling an air conditioning system having a first air conditioning unit and a second air conditioning unit, wherein the first air conditioning unit and the second air conditioning unit are in heat exchange communication with a working fluid, comprising:

switching the first air conditioning unit from a cooling mode of the first air conditioning unit in which a flow of refrigerant is directed through a compressor of the first air conditioning unit, to a free-cooling mode in which the flow of refrigerant bypasses the compressor of the first air conditioning unit;

operating the second air conditioning unit for a predetermined period of time after switching the first air conditioning unit into the free-cooling mode;

wherein the second air conditioning unit is switched on and operated in a cooling mode of the second air conditioning unit in which a flow of refrigerant is directed through a compressor of the second air conditioning unit before switching the first air conditioning unit from the cooling mode of the first air conditioning unit to a free-cooling mode such that the second air conditioning unit is operating in the cooling mode of the second air conditioning unit while the first air conditioning unit is switching from the cooling mode of the first air conditioning unit to the free cooling mode;

wherein:

the first air conditioning unit includes a first refrigeration circuit having a first evaporator with a first working fluid inlet, a first working fluid outlet, and a first pump;

the second air conditioning unit includes a second refrigeration circuit having a second evaporator with a second working fluid inlet, a second working fluid outlet, and a second pump;

a first conduit and a second conduit connects the first and second evaporators;

a working fluid loop consists of the first evaporator, the second evaporator, the first conduit and the second conduit, such that the working fluid flows between the first and second evaporators via operation of a thermosiphon.

2. The method of claim 1, wherein operating the second air conditioning unit comprises in the cooling mode of the second air conditioning unit turning on the second air conditioning unit into the cooling mode of the second air conditioning unit if the second air conditioning unit is currently not running.

3. The method of claim 1, wherein operating the second air conditioning unit in the cooling mode of the second air conditioning unit comprises maintaining the operation of the second air conditioning unit if the second air conditioning unit is currently operating in the cooling mode of the second air conditioning unit.

4. The method of claim 1, wherein the first pump is separate and distinct from the first compressor.

5. The method of claim 1, wherein the second pump is separate and distinct from the second compressor.

* * * * *